US005187969A

United States Patent [19]

Morita

[11] Patent Number: 5,187,969

[45] Date of Patent: Feb. 23, 1993

[54] LEAF SPRING CAMBERING METHOD AND APPARATUS

[75] Inventor: Motoo Morita, Komaki, Japan

[73] Assignee: Morita and Company Co. Ltd., Nagoya, Japan

[21] Appl. No.: 536,917

[22] Filed: Jun. 12, 1990

[30] Foreign Application Priority Data

Feb. 13, 1990 [JP] Japan ..... 2-32020

[51] Int. Cl.[5] ..... B21D 37/02; B21J 13/00; B23P 13/00

[52] U.S. Cl. ..... 72/413; 72/446; 29/173

[58] Field of Search ..... 72/413, 473, 482, 446, 72/447, 396, 397; 29/173; 148/11.5 R

[56] References Cited

U.S. PATENT DOCUMENTS

| | | | |
|---|---|---|---|
| 1,019,073 | 3/1912 | Nazel | 72/413 |
| 1,105,982 | 8/1914 | Litchfield et al. | 72/413 |
| 1,465,152 | 8/1923 | Williams et al. | 72/413 |
| 2,334,520 | 11/1943 | Walters | 72/413 |
| 2,783,815 | 3/1957 | Tegarden | 72/413 |
| 3,426,569 | 2/1969 | Brauer et al. | 72/413 |
| 3,429,156 | 2/1969 | Ericksson | 72/413 |
| 4,212,188 | 7/1980 | Pinson | 72/446 |
| 4,294,102 | 10/1981 | Lückert et al. | 72/413 |
| 4,572,250 | 2/1986 | Maben | 72/413 |

*Primary Examiner*—Lowell A. Larson

*Assistant Examiner*—Thomas C. Schoeffler

*Attorney, Agent, or Firm*—Schwartz & Weinrieb

[57] ABSTRACT

Disclosed is a method and an apparatus for cambering a leaf spring by pressing a heated leaf spring element or member between a pair of molds, characterized in that the pair of molds each comprises a plurality of mold fingers which can be advanced or retracted relative to the opposite mold by operating a plurality of drive means connected to the plurality of mold fingers based upon a predetermined command transmitted from a control means so as to advance or retract the fingers to required heights, respectively, so that the free ends of the mold fingers as a whole may form a required mold surface; and each mold finger is locked by a releasable locking means. The cambering apparatus may further comprise a tempering section, in which the pair of molds, together with the cambered leaf spring, are designed to be immersed within the tempering liquid contained within a liquid tank so as to effect tempering of the cambered leaf spring. In accordance with new command signals for leaf springs for different camber specifications, each of the mold fingers of the two molds is again connected to the corresponding drive means and the drive means is operated under the control command from the control means so as to likewise form a continuous mold surface in accordance with the different specifications.

22 Claims, 12 Drawing Sheets (a)

(b)

(c)

LEAF SPRING CAMBERING METHOD AND APPARATUS

FIELD OF THE INVENTION

This invention relates to a method of Cambering a leaf spring and an apparatus therefor, and more particularly to a method which can greatly reduce the mold setup time and improve the production efficiency by eliminating the need for replacing the cambering molds in accordance with order changes, and an apparatus therefor.

BACKGROUND OF THE INVENTION

Land transportation vehicles such as, for example, railway trains and trucks are provided with suitable suspension devices made by laminating together a plurality of leaf springs 10 as shown in FIG. 7. Each leaf spring 10 is made from a rolled material with a necessary thickness which is, after the process of forming an eye at one or both ends of a plate material, or tapering the other end thereof, given a necessary "deflection," or camber, during the state wherein the whole material is heated. There are various types of cambers: the curvature gradually reduces or increases from the center toward both ends; the central part is formed flat, and the like, depending upon the use or load stress applied.

FIG. 8 illustrates an example of a prior art apparatus 12 for cambering leaf springs 10. The apparatus 12 basically consists of an upper mold 14 and a lower mold 16, and the upper mold 14 has a female or concave shape, while the lower mold 16 has a male or convex shape. A leaf spring 10 immediately after being heated to the hot process temperature is inserted between the upper mold 14 and the lower mold 16, and then the upper mold 14 is forced to approach the lower mold 16 so as to impart to the plate 10 the camber in accordance with the surface shape of the molds 14 and 16. This cambered leaf spring 10 is then tempered by immersing it within a tempering oil contained within an oil tank.

In accordance with the foregoing, there is a serious problem that if such cambered leaf spring 10 is immersed within the oil without any constraint for the leaf spring 10 while carrying out the tempering thereof, it is distorted during the cooling process. A countermeasure for such has been proposed by means of which the cambered leaf spring 10 is constrained as it is, and immersed within the oil in this state so as to prevent the distortion which may occur during the cooling process.

For example, the distortion preventive means shown in FIG. 9 comprises a plurality of movable claw members 22 provided upon a conveyor 20 which is movable within an oil tank 18 and which are designed to mechanically hold the leaf spring elements 10 at strategic positions. Namely, the leaf spring 10 to which the required camber has been given by means of the cambering apparatus 12 is held by means of the group of claws 22 located at the entrance side of the oil tank 18, and the conveyor 20 is then circulated with the leaf springs 10 held thereon thereby immersing them within the oil so as to carry out the tempering thereof.

The distortion preventive means shown in FIG. 10 rotatably supports therein an octagonally shaped main body 24. The main body 24 has cambering apparatus 12 mounted upon each surface thereof and the lower part of the main body 24 is designed to be immersed within the oil contained within the oil tank 18. A heated straight leaf spring element or member 10 is loaded upon the cambering apparatus 12 at a position located above the oil level and held between the upper mold 14 and the lower mold 16 so as to carry out the cambering thereof. Then, the main body 24 is rotated in the above state so as to immerse the cambered leaf spring 10 within the oil contained within the oil tank 18 as the spring element 10 is held between the upper mold 14 and the lower mold 16.

Furthermore, in accordance with the distortion preventive means shown in FIG. 11, each leaf spring element 10 is cambered by pressing it between an upper mold 14 and a lower mold 16 of the cambering apparatus 12, and then the cambering apparatus 12 is immersed within the oil contained within an oil tank 18. The cambering apparatus 12 is moved within the oil tank 18 by an appropriate carrying means so as to carry out tempering of each cambered leaf spring 10 loaded within the cambering apparatus 12. After the cambering apparatus 12 is removed from the oil tank 18, the upper mold 14 and the lower mold 16 are separated from each other so as to remove the tempered leaf spring 10. Still further, the distortion preventive means shown in FIG. 12 comprises a single cambering apparatus 12 which is designed to hold the plate spring 10 tightly between the upper mold 14 and the lower mold 16 and to immerse the thus held leaf spring 10 within the oil tank 18. The oil tank 18 is pivoted by means of an appropriate pivoting means so that the leaf spring 10 held by means of the cambering apparatus 12 may be properly tempered.

For manufacturing such cambered leaf springs 10, there are two kinds of methods: (1) to effect cambering of leaf springs 10 of the same shape and specification continuously within a group or by means of group processing (the industry calls this method "Group making"), and (2) a family of leaf springs 10 comprising the main leaf spring 10 and the smaller leaf springs 10 constituting a suspension device are cambered together (the industry calls this method "Family making"). It depends upon the users' choice considering the application and other factors as to which method is used for cambering the leaf springs. In the Group making method, a required number of leaf springs of the same shape are cambered together, and only when the shape of the camber is changed, the upper mold 14 and the lower mold 16 of the cambering apparatus 12 are replaced. The systematic processing for replacing these molds usually requires a considerable amount of time, which has been a major factor significantly lowering the efficiency in connection with the leaf spring cambering work. Especially today when small lot production is pervasive, makers are required to respond to frequent order changes within such production system, and consequently, the reduction of the setup time required for the replacement of the molds is a highly important concern within the industry.

Furthermore, in accordance with the Family making method, the family of leaves comprises leaf members having slightly different cambers, so that the upper mold 14 and the lower mold 16 have to be replaced each time one of the leaves 10 is cambered. Therefore, the latter method involves extremely troublesome replacement work and increased loss of production time. The conventional cambering systems have therefore failed to meet the needs of the industry in this respect. Whether the Group making method or the Family making method is employed, many kinds of upper molds 14 and lower molds 16 corresponding to a variety of camber size requirements are necessary, leading to a great increase in production costs. Moreover, these molds have to be stored in groups of the same type, requiring an enormous storage space, and therefore giving rise to problems wherein their storage and maintenance becomes quite complex.

From another viewpoint, the following problems have also been encountered in connection with those proposed methods for preventing distortions suffered by means of the leaf springs 10 when they are subjected to the tempering process subsequent to the cambering process.

Namely, in the method described in connection with reference to FIG. 9, although the degree of distortion can be reduced as compared with the case when the leaf spring 10 is not constrained, distortion still occurs at the unconstrained portions since leaf spring 10 is not entirely constrained by only partly constrained at predetermined locations thereof. In the method described in connection with reference to FIG. 10, the cambered leaf spring 10 is immersed within the oil as it is entirely constrained within the cambering apparatus, so that the occurrence of distortion can in fact be prevented. However, such distortion prevention system tends to be complicated in structure and expensive. In this method, since the main body 24 rotates, the leaf springs 10 are immersed within the oil in an inclined state, which may cause another problem that a different kind of distortion is liable to be caused within the leaf spring which is different from the ones caused by means of the other methods described above.

The method described and illustrated in connection with FIG. 12 has the merit of minimizing distortion as compared with the methods shown in FIGS. 9 through 11, but suffers the disadvantage of extremely low productivity. Furthermore, the methods shown in FIGS. 9 through 12 involve such common disadvantages in that they require very troublesome work including adjustment of the claw members 22 for properly constraining the leaf springs 10 and for replacing the molds 14 and 16 according to the order changes for a particular leaf spring 10, and obviously such setup procedures require much time. Moreover, the methods described in connection with and illustrated within FIGS. 9 through 12 also suffer problems that, since the cambering apparatus 12 itself is immersed within the oil for carrying out the tempering of the leaf springs, a plurality of molds 14 and 16 corresponding to the respective camber specifications have to be prepared, leading to increased production costs.

OBJECT OF THE INVENTION

In view of the aforenoted problems inherent in the leaf spring cambering systems and methods of manufacture, this invention has been proposed to solve them in a suitable manner, and its object is to provide a novel method and an apparatus for cambering leaf spring elements or members which can improve the productivity thereof by greatly reducing the time required for the setup and replacement of the molds in accordance with the different order changes.

SUMMARY OF THE INVENTION

In order to overcome the above-mentioned problems and attain the intended object, one aspect of this invention is to provide a method for cambering a leaf spring by loading a heated leaf spring element or member between a pair of molds retractably disposed with respect to each other so as to oppose each other and bringing these molds closer together so as to hold the leaf spring element or member tightly therebetween so as to effect cambering thereof in accordance with the opposed surfaces of the molds, characterized in that:

the pair of molds each comprises a plurality of mold fingers which can be advanced or retracted relative to the opposite mold;

a plurality of drive means connected to the plurality of mold fingers are operated based upon a predetermined command signal transmitted from a control means so as to advance or retract the fingers to required heights, respectively, so that the free ends of the mold fingers as a whole may form a required mold surface; and each mold finger is locked by means of a releasable locking means.

A second aspect of this invention is to provide an apparatus for cambering a leaf spring having a pair of molds retractably disposed so as to oppose each other, wherein the molds each comprises:

a plurality of mold fingers constituting each mold which can be advanced or retracted relative to the opposite mold;

a plurality of drive means connected to the plurality of mold fingers for advancing or retracting them to required heights, respectively;

a control means for transmitting control commands to the respective drive means so as to advance or retract the respective mold fingers so that the free ends of the mold fingers as a whole may form a predetermined continuous mold surface; and a plurality of releasable locking means which immobilizes the respective mold fingers after they are adjusted to required heights by means of the respective drive means.

Furthermore, a third aspect of this invention is to provide a method for cambering a leaf spring which uses a pair of molds which are separably installed so as to oppose each other so as to effect cambering of a heated leaf spring element or member loaded therebetween in accordance with the opposed surfaces of the molds and as a result of bringing them closer together so as to press the leaf spring element or member tightly therebetween, characterized in that:

the pair of molds each comprises a plurality of mold fingers which can be advanced or retracted relative to the opposite mold;

a plurality of drive means which can separably be connected respectively to the plurality of mold fingers are operated under a predetermined control command signal transmitted from a control means so as to advance or retract the mold fingers to required heights, respectively, so that the free ends of the mold fingers as a whole may form a predetermined continuous mold surface;

each of the mold fingers is immobilized by means of the locking mechanism and the drive means are separated from the mold fingers;

a leaf spring element or member is loaded between the molds so as to be pressed tightly therebetween so as to effect the desired required cambering thereof, the two molds, together with the cambered leaf spring, are immersed within a tempering liquid contained with a liquid tank so as to effect tempering of the cambered leaf spring;

the two molds are withdrawn from the liquid tank and separated so as to permit removal of the leaf spring; and each of the mold fingers of the two molds is again connected to the corresponding drive means, in accordance with a new command signal for cambering leaf springs of different camber specifications, and the drive means is operated in accordance with the control command signal from the control means so that the free ends of the mold fingers as a whole may form a continuous mold surface in accordance with the different camber specifications.

Still further, in accordance with another aspect of this invention, an apparatus for cambering a leaf spring is provided and has a pair of molds separably disposed so as to oppose each other, characterized in that the apparatus comprises:

an independent cassette unit consisting of a pair of molds each having a plurality of mold fingers which can be advanced or retracted relative to the opposite mold;

a plurality of drive means which can separably be connected to the plurality of mold fingers so as to advance or retract them relative to the opposite mold and to predetermined required heights, respectively;

a control means which gives control commands to the respective drive means so as to advance or retract the mold fingers so that the free ends of the mold fingers as a whole may form a required continuous mold surface; and a releasable locking mechanism for immobilizing the mold fingers which have been advanced or retracted to required heights, by the respective drive means.

As explained above, according to the leaf spring cambering methods and apparatus of this invention, since a plurality of mold fingers define the mold for cambering the leaf springs, arbitrary cambered shapes can be formed by adjusting the height of each mold finger, thus shortening the time required for the setup of the mold in accordance with the other changes so as to greatly improve the production efficiency. Furthermore, according to this invention, there is no need for manufacturing or maintaining many different types of molds corresponding to various cambered shapes and consequently, mold production costs or storage and maintenance costs can advantageously be reduced.

Furthermore, since the mold fingers can automatically be positioned based upon the numerical data inputted beforehand, a change of the mold shape in accordance with an order change can be carried out speedily. Moreover, the mold adjustment requires no direct intervention by means of operators, leading to labor and power savings. In accordance with the disclosed inventions, the leaf springs can be immersed within the oil while they are constrained between the molds, so that any distortion which may otherwise occur during the tempering process can effectively be prevented.

BRIEF DESCRIPTION OF THE DRAWINGS

Various other objects, features, and attendant advantages of the present invention will become better understood from the following detailed description, when considered in connection with the accompanying drawings, in which like reference characters designate like or corresponding parts throughout the several views, and wherein.

PREFERRED EMBODIMENT OF THE INVENTION

Next, the method of cambering a leaf spring and an apparatus therefor according to this invention will be described below in detail by way of preferred embodiments and with reference to the attached drawings.

Figure 1:
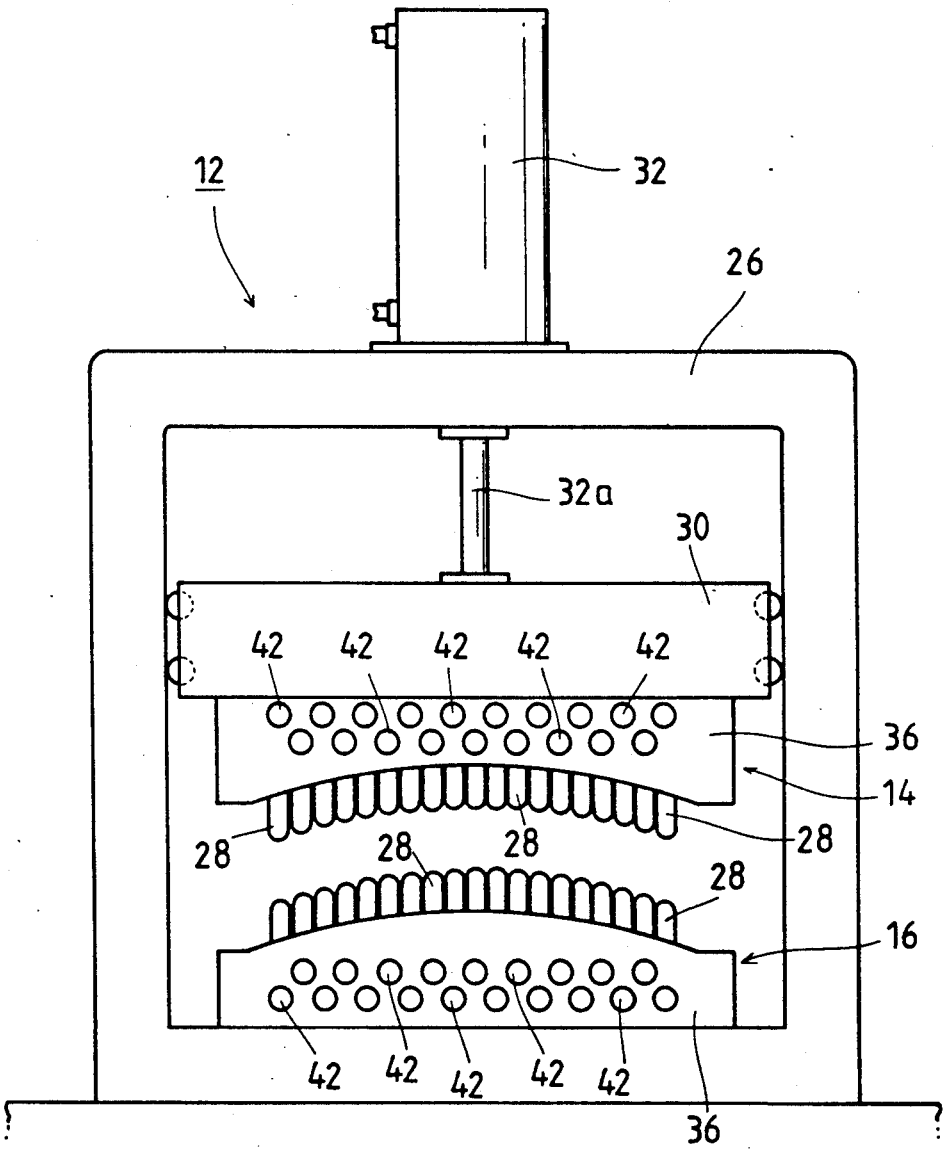
FIG. 1 shows schematically a construction of a cambering apparatus by means of which the present method of cambering a leaf spring can be suitably realized.

FIG. 1 shows schematically the constitution of an exemplary cambering apparatus in which the cambering method of the present invention can be suitably practiced. As shown in the drawing, a lower mold 16 is disposed at the bottom of a rectangular base frame 26 with its mold fingers 28 (to be described later) extending upwardly, and wherein there is also disposed within the frame 26 a press head 30 which is descendable or ascendable. Upon the bottom surface of the press head 30 an upper mold 14 is fixed with its mold fingers 28 directed downwardly toward the lower mold 16.

Upon the base frame 26, a fluid pressure cylinder, preferably a hydraulic cylinder 32 is inversely disposed with its piston rod **32*a* extending into the base frame 26. The end of this piston rod 32*a* is connected to the press head 30. By selectively driving the hydraulic cylinder 32 in the positive or negative direction, the upper mold 14 fixed upon the press head 30 can be brought closer to or spaced farther from the lower mold 16**.

Figure 2:
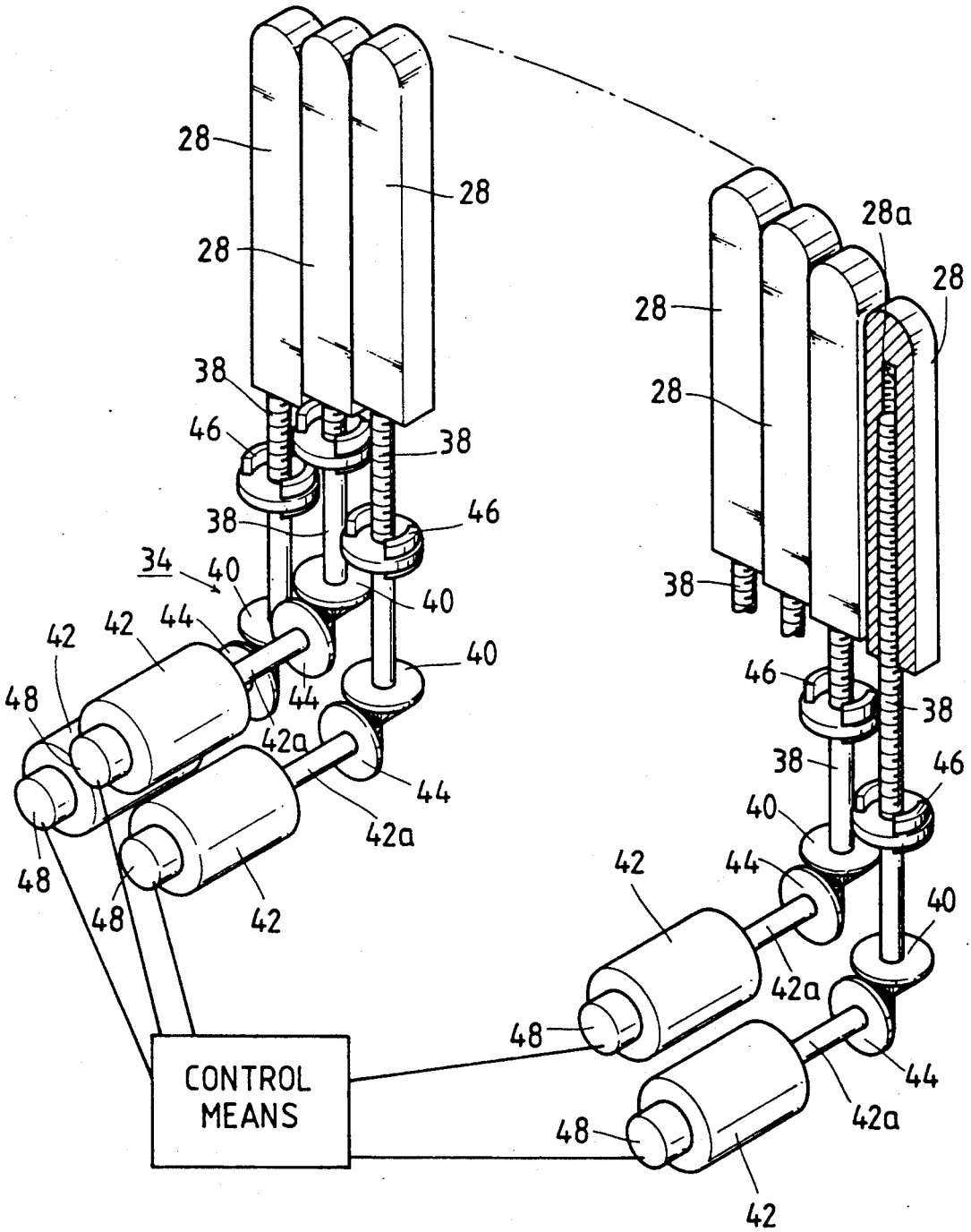
FIG. 2 shows schematically a perspective view of the mold finger adjustment mechanism of the apparatus of FIG. 1.

Furthermore, an adjustment mechanism 34, as best seen in FIG. 2, for changing the shape of the leaf spring cambering mold is provided upon each one of the upper and lower molds 14 and 16. Since the same mechanism is used for molds 14 and 16, only the one for the lower mold 16 will now be explained, and as for the adjustment mechanism 34 in the upper mold 14 the corresponding members are indicated with the identical reference numbers.

As shown in FIG. 1, upon the finger holder 36, which is a constituent of the lower mold 16, there is disposed a multiplicity of mold fingers 28 with their tips protruding from the top surface of the holder 36 to predetermined heights, respectively, the mold fingers 28 being capable of advancing or retracting vertically with respect to holder 36. These mold fingers 28 are arranged in parallel with respect to one another along the length of the holder 36, so that the curve connecting their tips or free may form a continuous cambering mold shape.

With each mold finger 28, as shown in FIG. 2, there is defined a tapped hole 28*a*, into which a threaded shaft 38 is vertically disposed. At the lower end of this threaded shaft 38 which is protruding downwardly from the mold finger 28, there is disposed, for example, a bevel gear 40. Upon the front side of the finger holder 36, servo motors 42 are provided in a corresponding number to that of the mold fingers 28, and a bevel gear 44 attached to the power shaft 42*a* of each motor 42 engages the bevel gear 40 of the threaded shaft 38. Therefore, when a particular servo motor 42 is selectively rotated normally or reversely, the corresponding mold finger 28 can be advanced or retracted correspondingly. The threaded shaft 38 is provided with a brake 46 which functions as a locking mechanism so as to immobilize the mold finger 28 at an arbitrary position after it has been advanced or retracted by means of the servo motor 42 to a required height.

Each servo motor 42 is provided with a position detector 48 which detects the current position of the mold finger 28 by detecting the revolutional frequency of the motor 42, therefore the accurate position of the mold finger 28 can constantly be monitored thereby. The signal from the position detector 48 concerning the current position of the mold finger 28 is inputted into a control means incorporating, for example, a microcomputer. Therefore, if data for the desired cambering mold shape is preliminarily inputted into this control means, the operation of the servo motor 42 can be controlled based upon the data so as to facilitate changing of the mold shape to be formed by means of the mold fingers 28.

EFFECT OF THE METHOD DESCRIBED ABOVE

Next, the effect of the cambering method which is practiced by operating the cambering apparatus having the above-mentioned constitution will now be explained. Before operating the cambering apparatus 12, predetermined data for the cambering mold shapes are inputted into the control means provided within the cambering apparatus 12. The operation of the servo motors 42 connected to the respective mold fingers 28 upon the upper mold 14 and the lower mold 16 is controlled based upon the forenoted data so as to advance or retract the molding fingers 28 to required heights, respectively. Upon completion of the positioning of all of the mold fingers 28 in this way, the brakes 46 are actuated so as to lock the respective mold fingers 28, whereby the desired cambering mold shape can be formed upon the opposed surfaces of the upper mold 14 and the lower mold 16. It is to be noted that these preparatory operations are carried out with the upper mold 14 and the lower mold 16 being spaced from each other by means of a predetermined distance.

Figure 3:
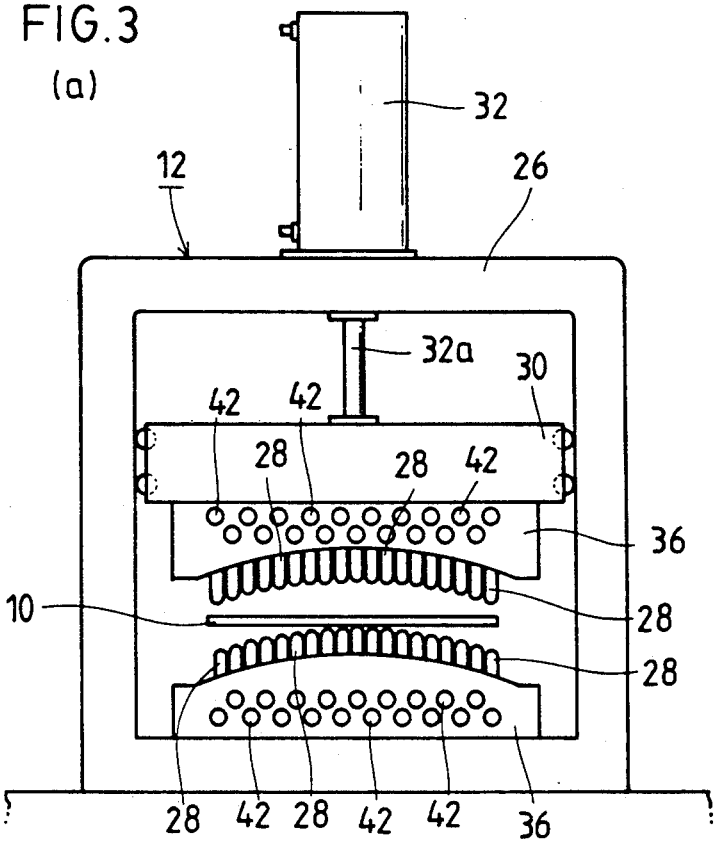
FIG. 3(*a*) through FIG. 3(*c*) explain the actions of the cambering apparatus shown in FIG. 1 with the passage of time when it is operated.
Figure 3:
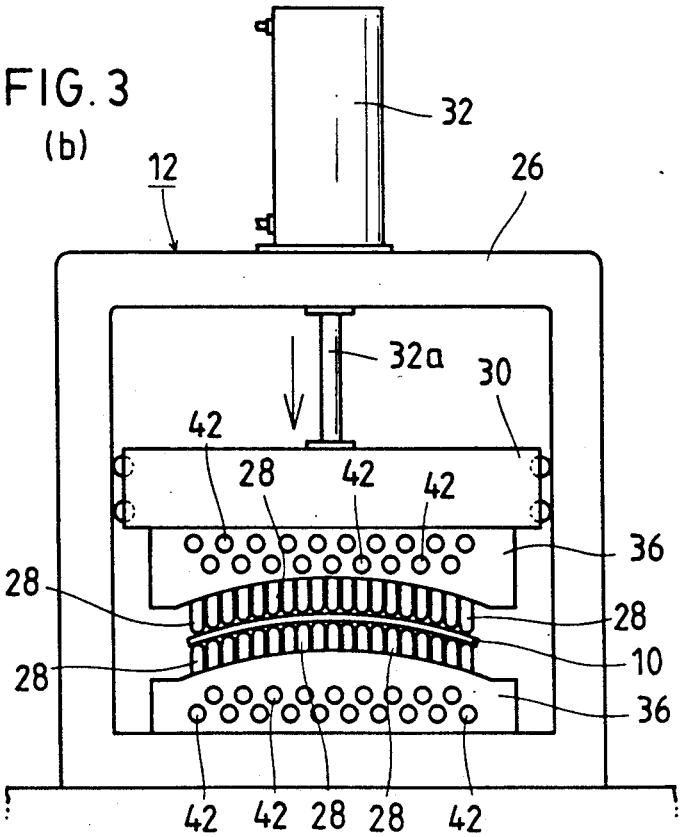
Figure 3:
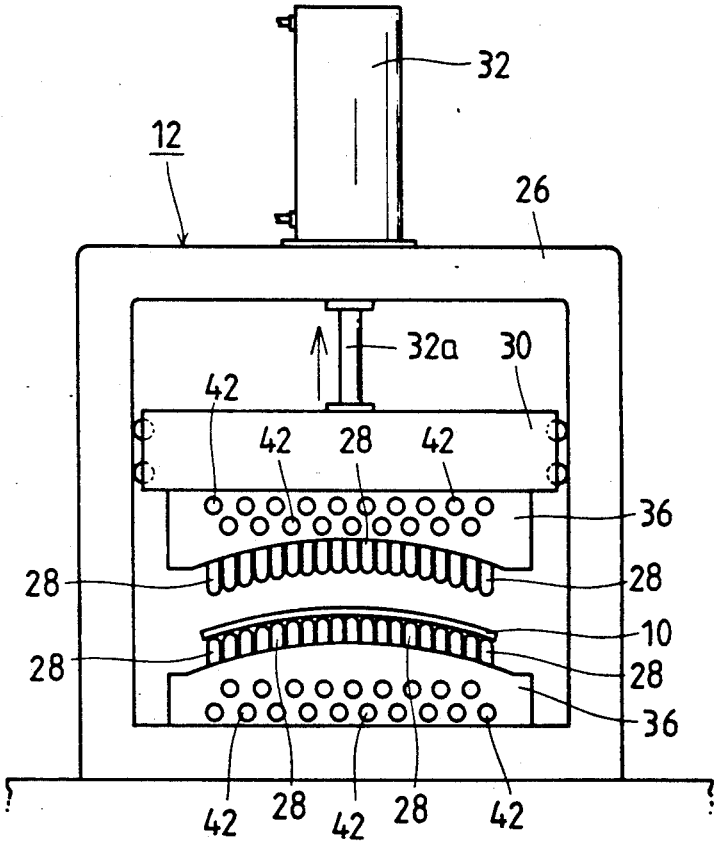

Subsequently, as shown in FIG. 3(*a*), a straight or planar leaf spring 10 heated to a predetermined temperature is loaded between the upper mold 14 and the lower mold 16. By driving the hydraulic cylinder 32 so as to extend the piston rod 32*a* downwardly, the upper mold 14 is descended so as to press the leaf spring 10 tightly between the two molds 14 and 16 (see FIG. 3(*b*)). Since the mold shape for obtaining the desired camber has been formed by means of the mold fingers disposed upon the opposed surfaces of the upper mold 14 and the lower mold 16 as described above, the leaf spring 10 achieves the desired camber in accordance with the configuration defined by means of the molds 14 and 16. Then, after the hydraulic cylinder 32 is reversely operated so as to ascend the upper mold 14, as shown in FIG. 3(*c*), the cambered leaf spring is removed from the cambering apparatus 12 and forwarded to the subsequent processing station, such as, for example, the tempering station, or the like.

Next, when leaf springs 10 of a different camber shape are to be formed in accordance with an order change, the data for the new mold shape is inputted into the control means, whereby the operation of each servo motor 42 is again controlled so that the mold fingers can form the newly desired mold shape upon the opposed surfaces of the upper mold 14 and the lower mold 16, respectively.

Namely, the desired cambering mold shape can be formed upon each of the opposed surfaces of the upper mold 14 and the lower mold 16 simply by inputting the data of the desired camber shape into the control means, thus reducing the time required for the setup of the molds in accordance with the order changes and thereby improving the production efficiency. Moreover, since there is no need for preparing a plurality of upper molds 14 and lower molds 16 corresponding to a variety of camber shapes, not only can the production costs be reduced but also the troublesome storage and maintenance of the plurality of molds can be eliminated.

Incidentally, the time required for the mold adjustment work can be further reduced if the data for the plurality of cambering mold shapes is preliminarily inputted into the control means so that the desired mold shape can be selected from such data by pressing a predetermined button in accordance with the order changes.

EMBODIMENT OF THE METHOD AND APPARATUS IN CONNECTION WITH FIGS. 4, 5, AND 6

Figure 4:
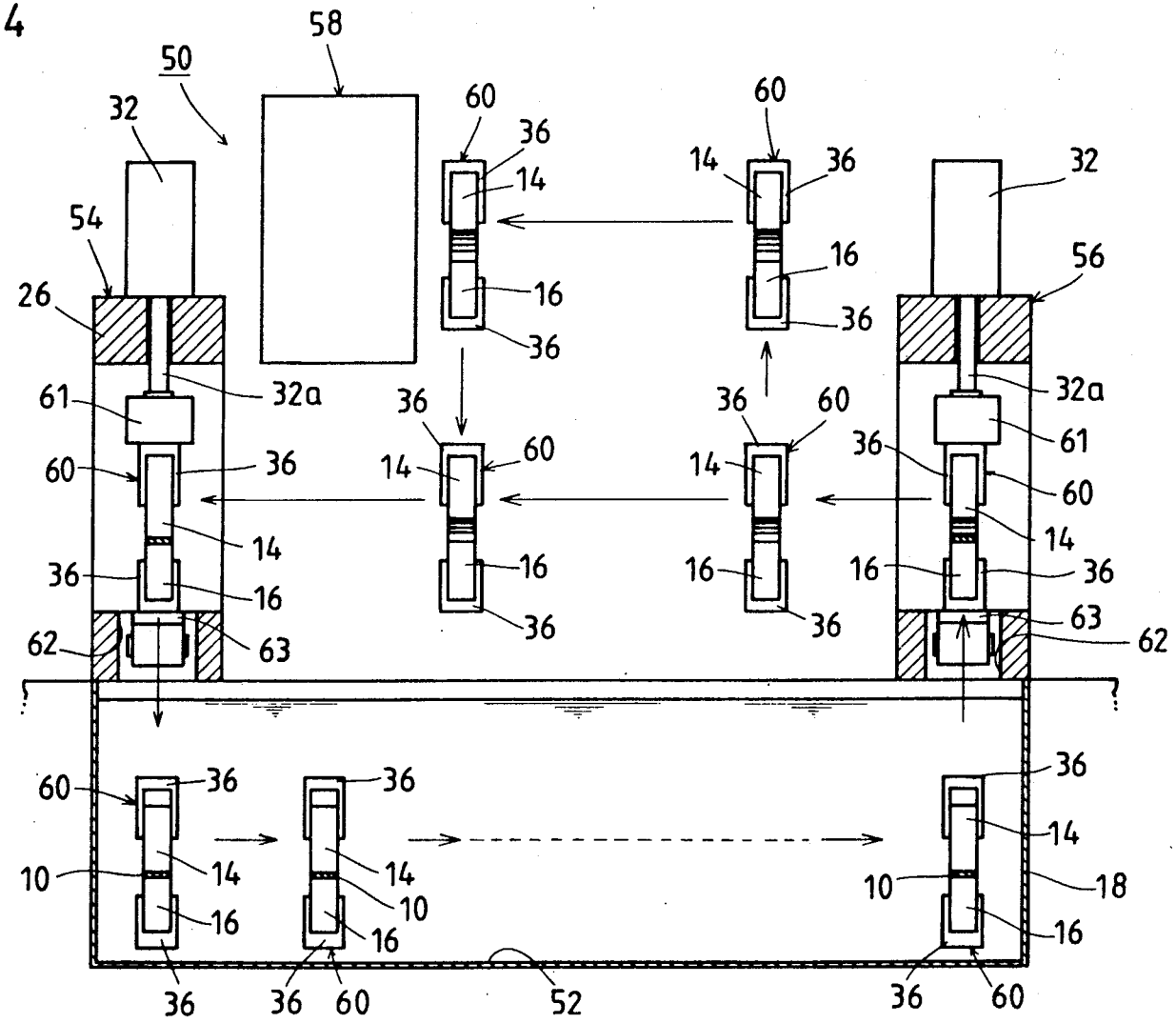
FIG. 4 shows schematically the construction of another embodiment of the cambering/tempering apparatus according to this invention.

FIG. 4 shows schematically the constitution of an exemplary cambering/tempering apparatus in which the cambering method of the present invention can be suitably practiced. As shown in the drawing, the cambering/tempering apparatus 50 basically comprises an oil tank 18 installed within a pit 52 which is dug to a required depth from the installation surface, a hydraulic press 54 provided above the oil tank 18 at one longitudinal end portion thereof, an unloading device 56 provided above the oil tank 18 at the other longitudinal end portion, and a setup unit 58 disposed at an appropriate intermediate position. The process of cambering and the tempering a leaf spring 10 and changing of the shapes of the upper mold 14 and the lower mold 16 is preformed by circulating an independent cambering cassette unit 60 consisting of the upper mold 14 and the lower mold 16 within the cambering/tempering apparatus 50.

HYDRAULIC PRESS

Since the hydraulic press 54 and the unloading device 56 are not substantially different from each other in connection with their structure, only the hydraulic press 54 will be explained here. As for the unloading device 56, the members corresponding to those of the hydraulic press 54 will be indicated by means of the identical reference numbers.

Figure 5:
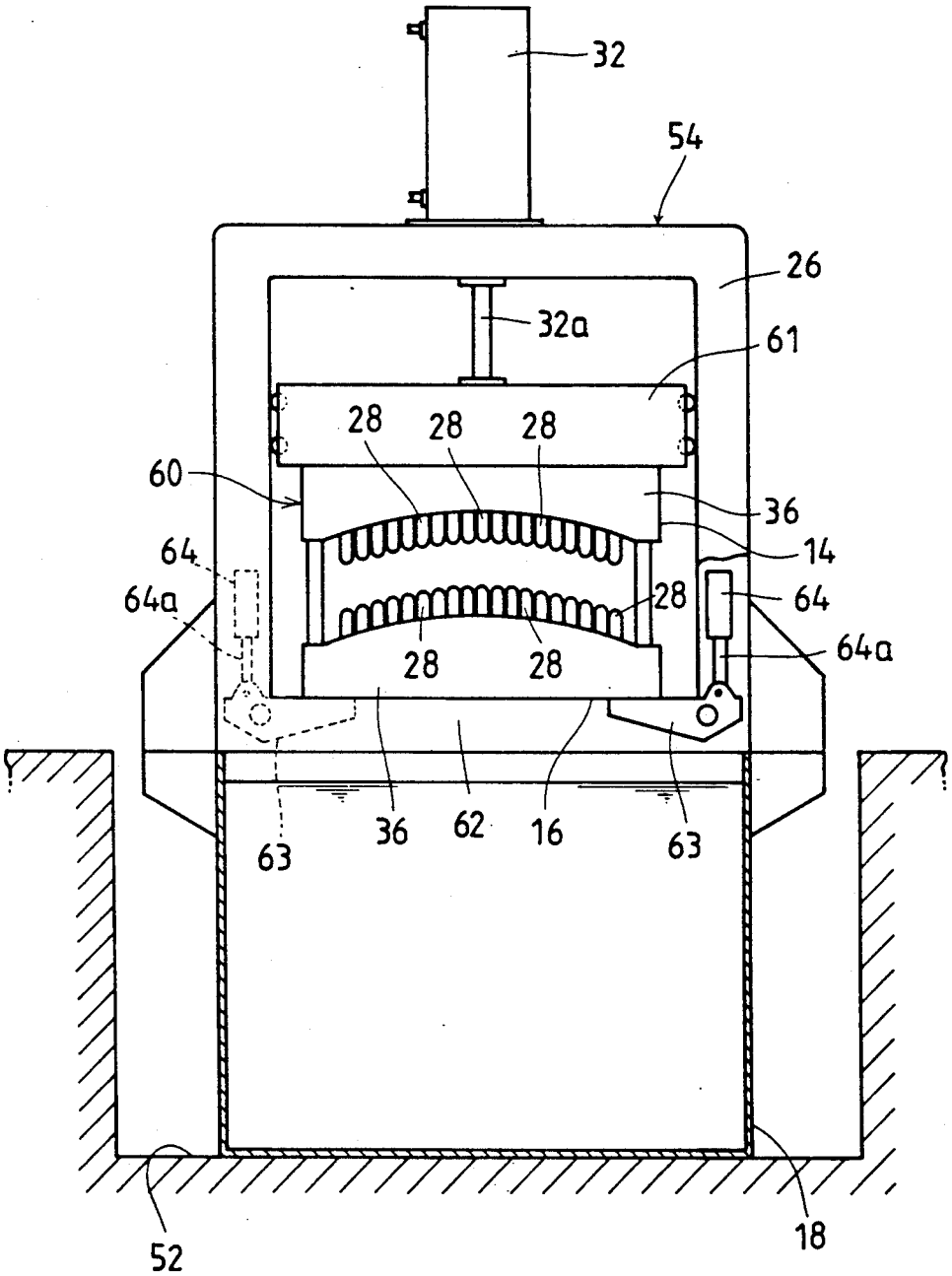
FIG. 5 shows schematically a partially cutaway view of the hydraulic press shown in FIG. 4.

As shown in FIG. 5, a base frame 26 having a rectangular shape is installed upon the top of the oil tank 18, and a hydraulic cylinder 32 is inversely provided upon the top of this base frame 26 with the piston rod 32*a* thereof extending into the base frame 26. Within the base frame 26, a head 61 is disposed so as to be ascendable or descendable, and to which said piston rod 32*a* is connected. Accordingly, when the hydraulic cylinder 32 is driven in the positive or negative direction, the head 61 can be ascended or descended within the base frame 26. It is to be noted that the head 61 of the hydraulic press 54 functions to descend the upper mold 14 within the cambering cassette 60 as detailed later, while the head 61 of the unloading device 56 functions to ascend the upper mold 14.

At the bottom of the base frame 26 a passage 62 for permitting the cambering cassette 60 to pass therethrough is formed as shown in FIG. 4, and a pair of opposed support members 63 are pivotally disposed upon each side of the passage 62. These support members 63 function to mount and maintain the cambering cassette 60 within the hydraulic press 54 and to also release the cassette 60 within the hydraulic press 54 and to also release the cassette 60 from the press 54 thereby permitting it to descend into the oil tank 18. Namely, as shown in FIG. 5, each of the support members 63 is adapted to extend its one end into the passage 62, while the other end thereof is connected to the piston rod 64*a* of the cylinder 64 installed within the base frame 26. By actuating each cylinder 64 in the positive or negative direction the support member 63 can be rotated so as to lock or release the cambering cassette 60.

CAMBERING CASSETTE

The cambering cassette 60 consists of an upper mold 14 and a lower mold 16 which can be brought closer together or farther away from each other, and each mold comprises a multiplicity of mold fingers 28 disposed within each holder 36 in the same manner as in the foregoing embodiment. In this cambering/tempering apparatus 50, however, the cambering cassette 60 itself is immersed within the oil, so that the adjustment of the mold fingers is designed to be performed in the setup device or unit 58 to be described later.

Figure 6:
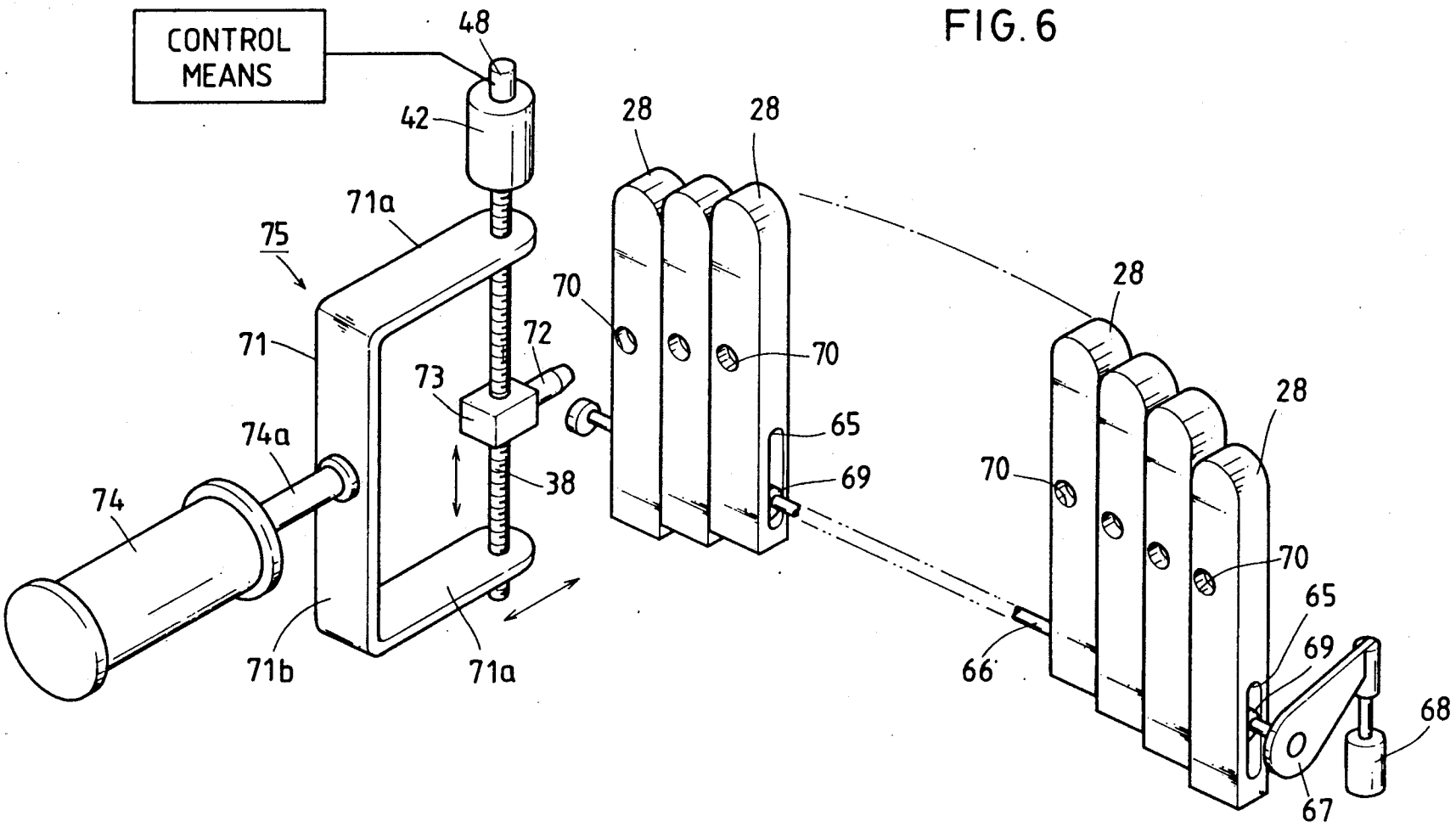
FIG. 6 shows schematically a perspective view of the mold finger adjustment mechanism disposed within the apparatus shown in FIG. 4.
Figure 7:
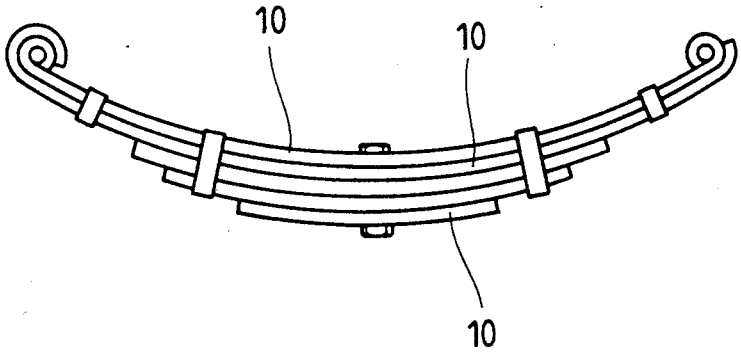
FIG. 7 illustrates a suspension device comprising leaf springs.
Figure 8:
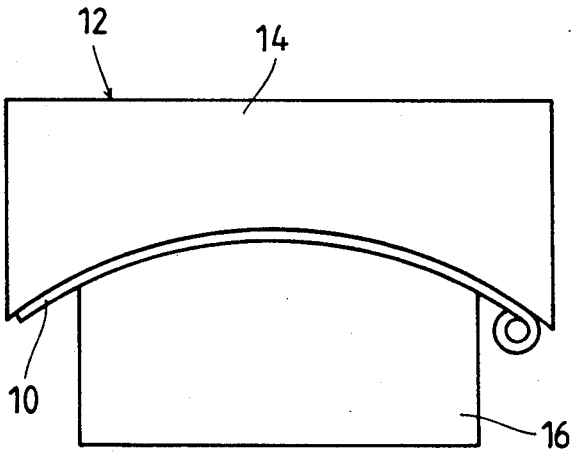
FIG.8 PRIOR ART
FIG. 8 illustrates a prior art cambering apparatus.
Figure 9:
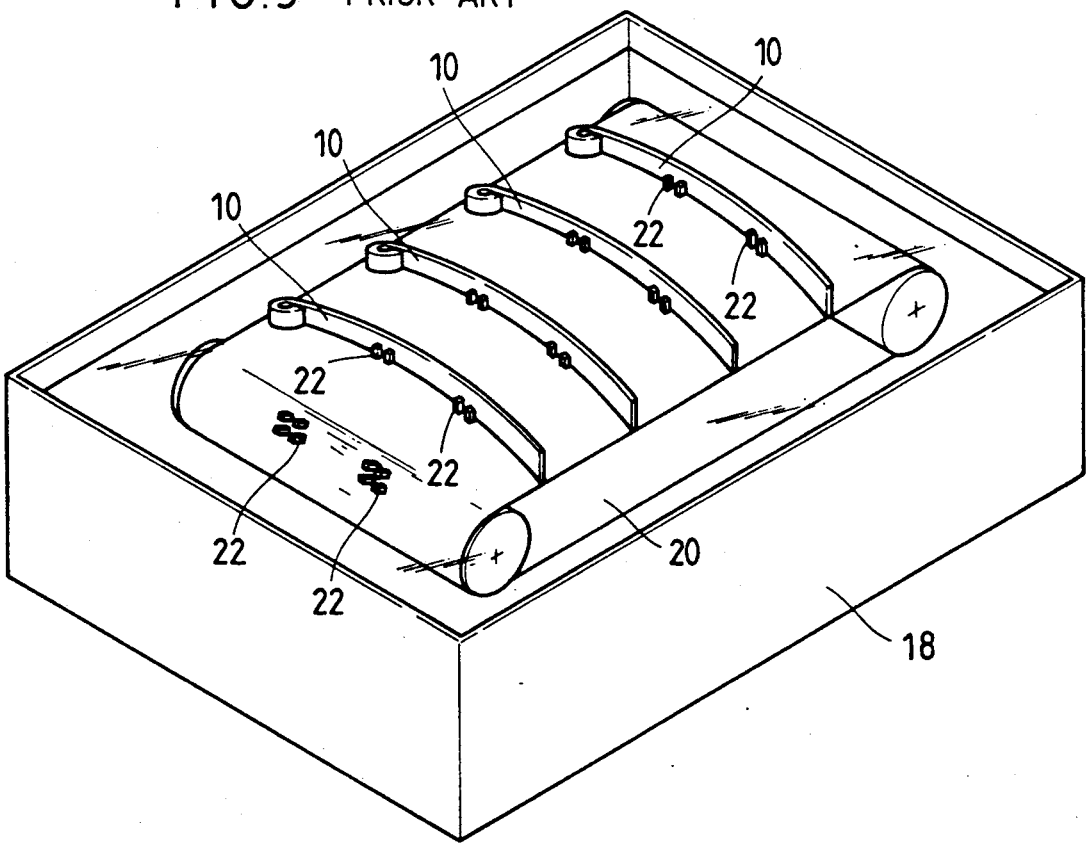
FIG.9 PRIOR ART
FIG. 9 shows schematically a perspective view of a prior art tempering apparatus.
Figure 10:
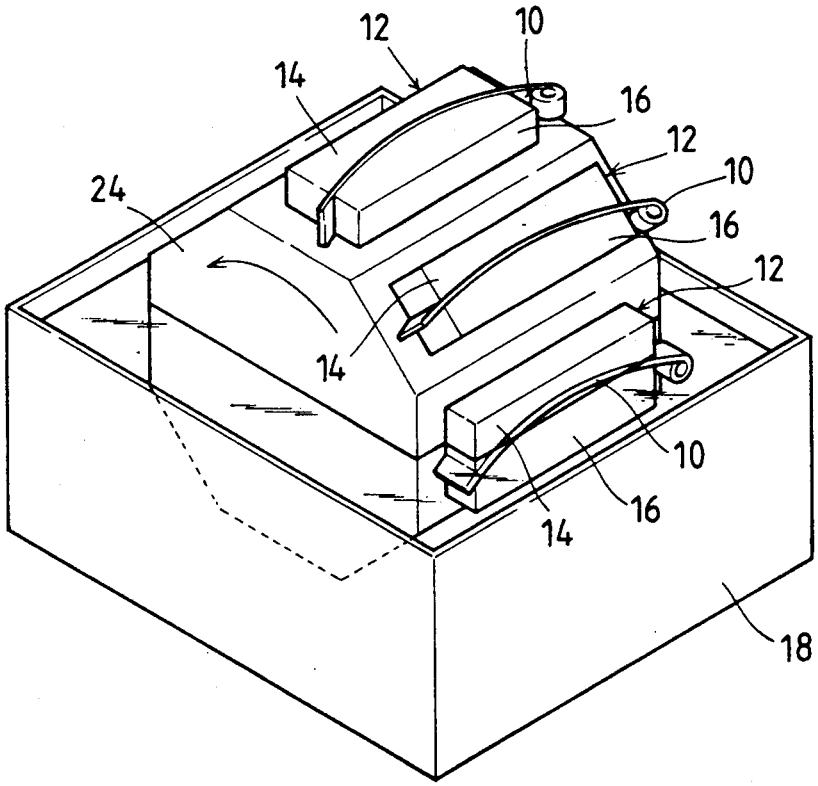
FIG.10 PRIOR ART
FIG. 10 shows schematically a perspective view of a prior art cambering/tempering apparatus.
Figure 11:
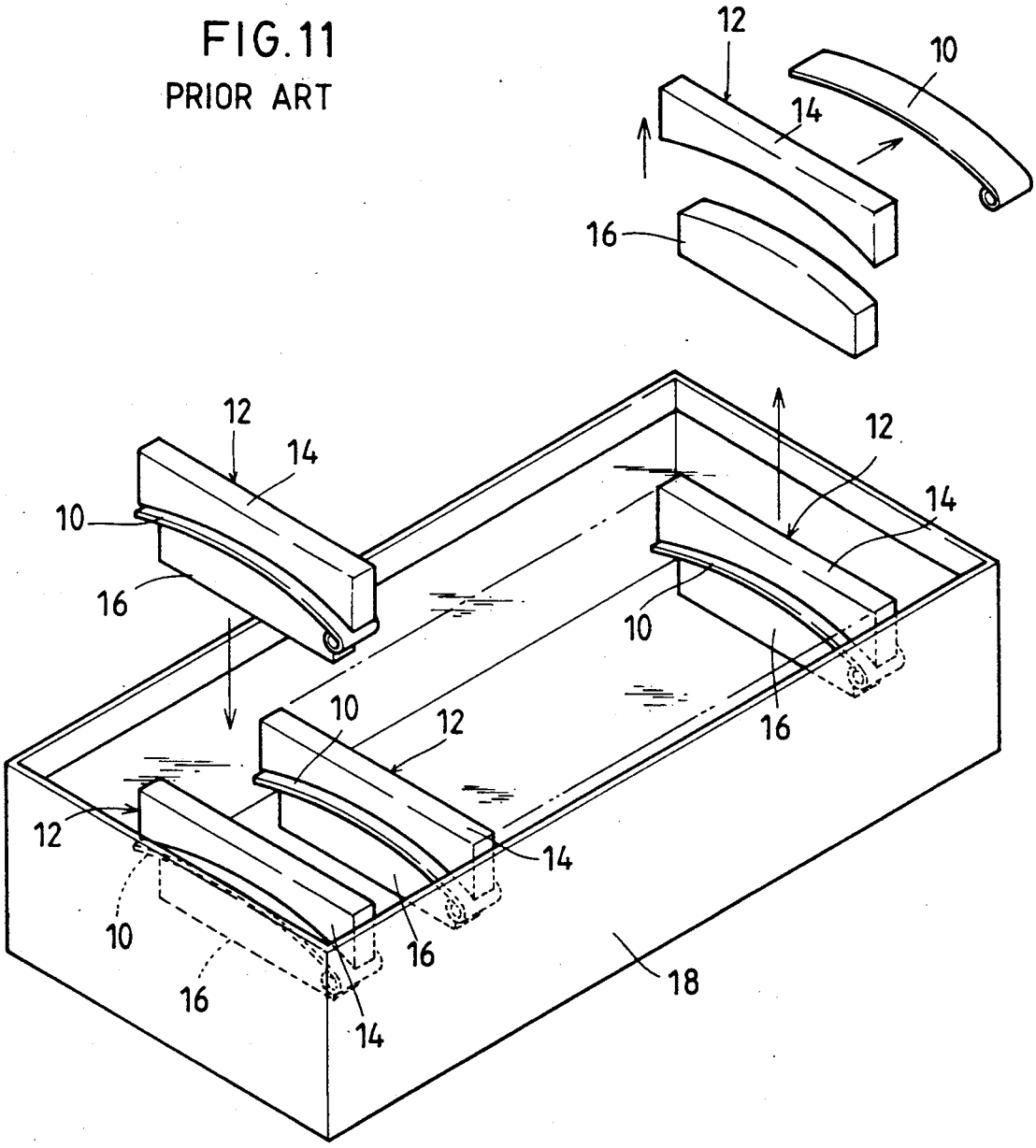
FIG. 11 PRIOR ART
FIG. 11 shows schematically a perspective view of another prior art cambering/tempering apparatus.
Figure 12:
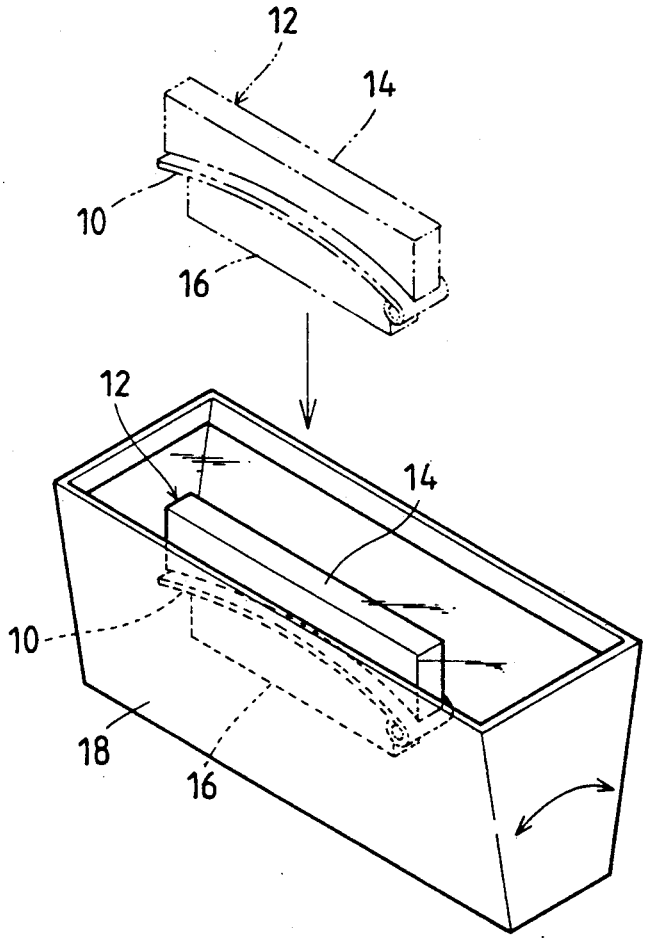
FIG. 12 PRIOR ART
FIG. 12 shows schematically a perspective view of still another prior art cambering/tempering apparatus.

A slot 65 is defined within each of the mold fingers 28, as shown in FIG. 6, and pivotal shafts 66 are inserted through the slots of all of the mold fingers 28 disposed within the lower mold 16 and the upper mold 14, respectively. These pivotal shafts 66 are each designed to be turned within a predetermined angular range by means of a cam 67 and a cylinder 68 provided at one end of the finger array. Furthermore, an eccentric cam 69 is fixed upon the pivotal shaft 66 at each position corresponding to the slot 65 of each finger 28. When the pivotal shaft 66 is turned, for example, in the clockwise direction, this eccentric cam 69 abuts against the inner wall of the slot 65 so as to prevent any shifting movement of the mold finger 28, whereas when the pivotal shaft 66 is turned in the counterclockwise direction, the finger 28 is designed to be shiftable. Still further, a hole 70 is formed at an appropriate position within each mold finger 28, which is used when the mold finger 28 is adjusted within the setup unit 58 to be described later.

SETUP UNIT

The setup unit 58 is provided and used for adjusting the protruding length of each mold finger 28 of the upper mold 14 and the lower mold 16 from the holder 36 so as to change the cambering mold shape to be formed thereby. While this apparatus has adjusters 75, as shown in FIG. 6, provided for the respective mold fingers 28 of the upper mold 14 and the lower mold 16, only one adjuster 75 is shown in the drawing.

Within the U-shaped support frame 71 of the adjuster 75, a threaded shaft 38 is rotatably supported between the upper and lower horizontal members 71*a*, 71*a* thereof, and a servo motor 42 is mounted upon the upper end of the threaded shaft 38. Upon the threaded shaft 38, there is threadedly engaged a nut 73 having a pin 72 fixedly mounted therein which can be inserted into the hole 70 formed within each mold finger 28. This nut 73 is designed to be fixed from rotating in connection with the rotation of the threaded shaft 38 by an appropriate means (not shown), so that the nut 73 can be ascended or descended along the threaded shaft 38 in a translational mode by rotating the servo motor 42 normally or reversely, and accordingly the shaft 38 which is operatively connected thereto.

Upon the vertical member 71*b* of the support frame 71 there is attached a piston rod 74*a* of a cylinder 74. By actuating the piston rod 74*a* in the positive or negative direction, the support frame 71 can be advanced or retracted correspondingly. Namely, when the cambering cassette 60 is disposed within the setup unit 58, the cylinder 74 is driven in the direction so as to extend the piston rod 74*a* so as to insert the pin 72 of the nut 73 provided upon the threaded shaft 38 into the hole 70 of the mold finger 28. The servo motor 42 is then driven normally or reversely so as to advance or retract the mold finger 28.

It should be noted that a position detector 48 is provided for each servo motor 42 so as to constantly monitor the accurate positioning of the mold finger 28 in the same manner as in the foregoing embodiment. The signal from the position detector 48 concerning the current position of the mold finger 28 is designed to be inputted into the control means.

EFFECT OF THE METHOD OF THIS EMBODIMENT

Next, the effect of the cambering method resulting from the operation of the cambering/tempering apparatus having the aforenoted constitution will be explained. First, the upper mold 14 and the lower mold 16 are separated and the cambering cassette 60 is disposed within the setup unit 58 with all of the mold fingers 28 thereof being released from the locked state by means of the eccentric cams 69. The cylinder 74 of the adjustor 75 is then actuated so as to bring the support frame 71 closer to the mold finger 28 until the pin 72 is inserted into the hole 70 of the finger 28. Subsequently, the operation of the servo motor 42 is controlled based upon the data concerning the cambering mold shape preliminarily inputted into the control means so as to effect adjustment of the mold finger 28. Upon completion of the adjustment of all of the mold fingers 28, the cylinder 68 is driven in the desired direction so as to turn the eccentric cams 69 and lock the mold fingers 28 at predetermined positions, respectively.

After completion of the adjustment of the mold fingers, the cambering cassette 60 is forwarded to the hydraulic press 54 and mounted and supported therein by means of the support members 63, as shown in FIG. 5. After a heated leaf spring element or member is loaded between the upper mold 14 and the lower mold 16, the hydraulic cylinder 32 is actuated so as to lower the upper mold 14 through means of the head 61, whereby the leaf spring element or member 10 is loaded between the upper mold 14 and the lower mold 16, the hydraulic cylinder 32 is actuated so as to lower the upper mold 14 through means of the head 61, whereby the leaf spring element or member 10 is caused to have the desired camber by means of the pressure exerted thereon and developed between the upper mold 14 and the lower mold 16. Incidentally, an appropriate means is of course employed in order to insure the fact that both molds 14 and 16 retain the leaf spring 10 therebetween.

When the cylinders 64 are actuated so as to pivot the support members 63 in the predetermined direction, the cambering cassette 60 descends through the passage 62 and is immersed within the oil contained therein the oil tank 18, whereby the leaf spring 10 is tempered as the cambering cassette 60 is carried through the oil tank 18, as schematically illustrated within FIG. 4, by an appropriate means (not shown). In this process, since the leaf spring 10 is entirely held between the upper mold 14 and the lower mold 16, any distortion which may otherwise occur can be prevented.

After being carried to the position immediately below the unloading device 56, the cambering cassette 60, as shown in FIG. 4, is removed from the oil tank 18 and mounted and supported within the unloading apparatus 56 by means of the support members 63, wherein the head 61 is fixedly restraining the upper mold 14, while the lower mold 16 is immobilized with an appropriate means. In this state, when the hydraulic cylinder 32 is actuated in the direction so as to retract its piston rod **32*a* into the cylinder casing, the upper mold 14 so as to release the leaf spring 10. The leaf spring 10 subjected to cambering and tempering is removed from the cambering cassette 60** by means of a take-out device (not shown) and forwarded to a subsequent processing station.

When a plurality of leaf springs 10 of the same camber shape are formed successively, the cambering cassette 60 is carried directly to the hydraulic press 54, and the same cycle of leaf spring cambering and tempering is repeated in the same manner as described above.

Next, when leaf springs 10 of a different camber shape are formed in accordance with an order change, the cambering cassette 60 is forwarded from the unloading device 56 to the setup unit 58, mounted therein, wherein the upper mold 14 and the lower mold 16 are already separated from each other, and the cylinder 68 is actuated in the predetermined direction so as to release the mold fingers 28 from the locked state by means of the eccentric cams 69. Then, each mold finger 28 of the upper mold 16 is adjusted within the setup unit 58 in the aforenoted manner, and the desired cambering mold shape is formed upon the opposed surfaces of the molds 14 and 16. After the adjustment of the mold fingers 28, the cambering cassette 60 is again forwarded to the hydraulic press 54, and the aforenoted cycle is repeated so as to form leaf springs 10 of a different camber shape.

According to this invention, the adjustment of the mold fingers 28 made by controlling the operation of the servo motors 42 based upon the data preliminarily inputted into the control means results in a significant reduction in the operational loss time associated with the order changes. Since the leaf spring 10 is immersed within the oil as it is constrained within the cambering cassette 60, any distortion which may otherwise occur during tempering can be prevented.

In the above embodiments, while the description of the invention has disclosed servo motors 42 as the drive means for the mold fingers 28, this invention is not limited thereto but a fluid pressure cylinder or other similar devices may be used for this purpose.

Obviously, many modifications and variations of the present invention are possible in light of the above teachings. It is therefore to be understood that within the scope of the appended claims, the invention may be practiced otherwise than as specifically described herein.

What is claimed is:

1. A method of cambering a leaf spring which uses a pair of molds separably installed within a cassette so as to oppose each other so as to effect cambering of a heated leaf spring element loaded therebetween in accordance with opposed surfaces of of said molds by bringing said molds together so as to press said leaf spring element tightly therebetween, comprising the steps of:

providing each one of said molds of said pair of molds with a plurality of mold fingers which define one of said opposed surfaces of said molds and which can be individually advanced and retracted relative to the opposite mold along a longitudinal axis defined within each of said mold fingers;

providing a plurality of drive means which can be separably connected respectively to said plurality of mold fingers at a set-up station for individually advancing and retracting said mold fingers to predetermined extents in order to define said mold surfaces;

providing control means for storing predetermined data corresponding to a predetermined camber to be imparted to said leaf spring and for transmitting control commands to said drive means disposed at said set-up station, in accordance with said stored predetermined data characteristic of said predetermined camber to be imparted to said leaf spring, so as to advance and retract said mold fingers to said predetermined extents, respectively, so that free end portions of said mold fingers may together form said mold surface having said predetermined camber to be imparted to said leaf spring;

disconnecting said drive means, disposed at said set-up station, from said mold fingers upon completion of said advancement and retraction of said mold fingers to said predetermined extents in order to define said mold surfaces;

transferring said cassette, comprising said molds and said mold fingers, from said set-up station to a press station;

loading a leaf spring element between said molds at said press station so as to be pressed tightly therebetween so as to effect said predetermined cambering thereof;

removing a said cassette, comprising said two molds and said cambered leaf spring element, from said press station and immersing said cassette, comprising said two molds, said mold fingers, and said cambered leaf spring element, within a tempering liquid contained within a liquid tank so as to effect tempering of said cambered leaf spring;

removing said cassette, comprising said two molds, said mold fingers, and said cambered leaf spring element, from said liquid tank;

separating said two molds with respect to each other so as to permit removal of said tempered leaf spring element; and connecting each one of said mold fingers of said two molds to said corresponding drive means dispersed at said set-up station in accordance with new control commands from said control means for cambering new leaf springs in accordance with different camber specifications, and operating said drive means, disposed at said set-up station, in accordance with said control commands from said control means so that free end portions of said mold fingers together form a new mold surface in accordance with said different specifications.

2. A method as set forth in claim 1, further comprising the step of:

providing said press station with pivotable support means for supporting said cassette, comprising said opposed molds, said mold fingers, and said leaf spring element, within said press station when said pivotable support means is disposed at a first pivotable position, and for releasing said cassette, comprising said opposed molds, said mold fingers, and said cambered leaf spring element, from said press station into said tempering tank means when said pivotable support means is disposed at a second pivotable position.

3. A method as set forth in claim 1, further comprising the steps of:

providing each of said drive means with a releasable locking means for locking each of said mold fingers at a predetermined position corresponding to said predetermined extent when said mold finger is moved to said predetermined extent in order to define one of said mold surfaces.

4. A method as set forth in claim 3, wherein:

said releasable locking means comprises cam means for cammingly engaging slot means defined within each one of said mold fingers.

5. Apparatus for cambering a leaf spring, comprising:

a cassette unit comprising a pair of opposed molds movably disposed toward and away from each other;

a plurality of mold fingers defining a mold surface within each one of said molds, wherein each one of said mold fingers can be individually advanced and retracted relative to the opposite mold along a longitudinal axis defined within each one of said fingers;

a plurality of drive means, which can be separably connected, respectively, to said plurality of mold fingers, disposed at a set-up station for individually advancing and retracting said mold fingers relative to said opposite mold and to predetermined extents so as to define said mold surfaces;

control means for storing predetermined data corresponding to a predetermined camber to be imparted to said leaf spring and for transmitting control commands to said drive means, disposed at said set-up station, in accordance with said stored predetermined data characteristic of said predetermined camber to be imparted to said leaf spring, so as to advance and retract said mold fingers to said predetermined extents so that free end portions of said mold fingers may together form said mold surface having said predetermined camber to be imparted to said leaf spring;

press station means for receiving said cassette, comprising said opposed molds and said mold fingers, from said set-up station upon completion of said advancement and retraction of said mold fingers to said predetermined extents in order to define said mold surfaces, and the disconnection of said drive means, disposed at said set-up station, from said plurality of mold fingers, and for receiving a leaf spring element between said molds so as to press said leaf spring element between said molds so as to impart said predetermined camber to said leaf spring element;

tempering tank means for receiving said cassette, comprising said opposed molds, said mold fingers, and said cambered leaf spring element pressed between said mold fingers to said molds, and within which there is disposed a tempering liquid within which said cassette, comprising said molds, said mold fingers, and said leaf spring element, is to be immersed so as to temper said cambered leaf spring element; and unloading station means for receiving said cassette, comprising said molds, said mold fingers, and said tempered cambered leaf spring element, from said tempering tank means and for opening said opposed molds so as to permit removal of said tempered, cambered leaf spring element from said molds.

6. Apparatus as set forth in claim 5, further comprising:

pivotable support means mounted upon said press station for pivotably supporting said cassette, comprising said opposed molds, said mold fingers, and said leaf spring element, within said press station when said pivotable support means is disposed at a first pivotable position, and for releasing said cassette, comprising said molds, said mold fingers, and said cambered leaf spring element, from said press station and into said tempering tank means when said pivotable support means is disposed at a second pivotable position.

7. Apparatus as set forth in claim 5, further comprising:

releasable locking means for locking each one of said mold fingers at a predetermined position corresponding to said predetermined extent when said mold finger has been moved to said predetermined extent in order to define one of said mold surfaces.

8. Apparatus as set forth in claim 7, wherein:

said releasable locking means comprises cam means for cammingly engaging slot means defined within each one of said mold fingers.

9. A method of cambering a leaf spring, comprising the steps of:

loading a heated leaf spring element into a cambering mold comprising a pair of opposed mold members movably disposed toward and away from each other, with said leaf spring element interposed between opposed mold surfaces of said opposed mold members; and moving said mold members toward each other so as to hold said leaf spring element tightly therebetween so as to effect cambering thereof in accordance with said opposed mold surfaces of said opposed mold members, and wherein said method further comprises the steps of:

providing each of said pair of opposed mold members with a plurality of mold fingers which define one of said opposed mold surfaces and which can be individually advanced and retracted relative to the opposite mold along a longitudinal axis defined within each of said mold fingers;

providing a plurality of drive means connected to said plurality of mold fingers for individually advancing and retracting said mold fingers to predetermined extents in order to define said mold surfaces;

providing control means for storing predetermined data corresponding to a predetermined camber to be imparted to said leaf spring element and for transmitting control commands to said drive means, in accordance with said stored predetermined data characteristic of said predetermined camber to be imparted to said leaf spring, so as to advance and retract said mold fingers to said predetermined extents so that free end portions of said mold fingers together form said mold surfaces having said predetermined camber to be imparted to said leaf spring element;

providing each of said plurality of mold fingers with an aperture extending transversely with respect to said longitudinal axis thereof; and providing each of said plurality of drive means with a threaded rod, and nut means threadedly engaged upon said threaded rod and operatively engaged within a respective aperture of a respective mold finger, such that upon actuation of said drive means by said control means, rotation of said threaded rods of said drive means about longitudinal axes defined within said threaded rods causes translational advancement or retraction of said nut means along said threaded rods, and corresponding advancement or retraction of said mold fingers along said longitudinal axes thereof as a result of said operative engagement defined between said nut means and said mold fingers.

10. A method as set forth in claim 9, further comprising the step of:

providing each of said drive means with a releasable locking means for locking each one of said mold fingers at a predetermined position corresponding to said predetermined extent when said mold finger is moved to said predetermined extent in order to define one of said mold surfaces.

11. A method as set forth in claim 10, wherein:

said releasable locking means comprises cam means for cammingly engaging slot means defined within each one of said mold fingers.

12. A method as set forth in claim 9, further comprising the step of:

mounting each one of said plurality of drive means relative to a respective one of said plurality of mold fingers such that said nut means is releasably engageable with said aperture respectively defined within said one of said plurality of mold fingers.

13. A method as set forth in claim 12, further comprising the steps of:

mounting said each one of said plurality of drive means within a support frame; and reciprocating said support frame toward and away from said respective one of said plurality of mold fingers so as to respectively engage and disengage said nut means within and from said aperture of said respective mold finger.

14. A method as set forth in claim 13, further comprising the step of:

fixedly connecting a piston-cylinder assembly to said support frame for reciprocating said support frame towar and away from said respective one of said plurality of mold fingers.

15. A method as set forth in claim 13, further comprising the steps of:

providing said support frame with a substantially C-shaped configuration; and mounting opposite end portions of said threaded rod within opposed support members of said support frame.

16. Apparatus for cambering a leaf spring, comprising:

a pair of opposed molds movably disposed toward and away from each other;

a plurality of mold fingers defining a mold surface within each one of said opposed molds and which can be individually advanced and retracted relative to the opposite mold along a longitudinal axis defined within each one of said mold fingers;

a plurality of drive means connected to said plurality of mold fingers for individually advancing and retracting said mold fingers to predetermined extents in order to define said opposed mold surfaces; and control means for storing predetermined data corresponding to a predetermined camber to be imparted to said leaf spring and for transmitting control commands to said drive means, in accordance with said stored predetermined data characteristic of said predetermined camber to be imparted to said leaf spring, so as to advance and retract said mold fingers to said predetermined extents so that free end portions of said mold fingers together form said mold surface having said predetermined camber to be imparted to said leaf spring;

each of said plurality of mold fingers having an aperture defined therein and extending transversely with respect to said longitudinal axis thereof; and said plurality of drive means each comprises a treaded rod, and nut means threadedly engaged upon said threaded rod and operatively engaged within said aperture of said mold finger, such that upon actuation of said drive means by said control means, rotation of said threaded rods of said drive means about longitudinal axes defined within said threaded rods causes translational advancement or retraction of said nut means along said threaded rods, and corresponding advancement or retraction of said mold fingers along said longitudinal axes thereof as a result of said operative engagement defined between said nut means and said mold fingers.

17. Apparatus as set forth in claim 16, further comprising:

releasable locking means for locking each one of said mold fingers at a predetermined position corresponding to said predetermined extent when said mold finger has been moved to said predetermined extent in order to define one of said mold surfaces.

18. Apparatus as set forth in claim 17, wherein:

said releasable locking means comprises cam means for cammingly engaging slot means defined within each one of said mold fingers.

19. Apparatus as set forth in claim 16, wherein:

each one of said plurality of drive means comprises means for mounting said each one of said plurality of drive means relative to a respective one of said plurality of mold fingers such that said nut means is releasably engageable with said aperture respectively defined within said one of said plurality of mold fingers.

20. Apparatus as set forth in claim 19, wherein said means for mounting said drive means comprises:

a support frame within which said threaded rod is rotatably mounted; and reciprocating means fixedly connected to said support frame for moving said support frame toward and away from said respective one of said plurality of mold fingers so as to respectively engage and disengage said nut means within and from said aperture of said respective mold finger.

21. Apparatus as set forth in claim 20, wherein:

said reciprocating means comprises a piston-cylinder assembly.

22. Apparatus as set forth in claim 20, wherein:

said support frame has a substantially C-shaped configuration with opposite end portions of said threaded rod rotatably mounted within opposed support members of said support frame.

* * * * *